US008661592B2

(12) United States Patent
Trice

(10) Patent No.: US 8,661,592 B2
(45) **Date of Patent: *Mar. 4, 2014**

(54) DEMOLITION TOOL

(71) Applicant: Evers C. Trice, Frederick, MD (US)

(72) Inventor: Evers C. Trice, Frederick, MD (US)

(73) Assignee: Trice Enterprise, LLC, Frederick, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/986,444

(22) Filed: May 3, 2013

(65) Prior Publication Data

US 2013/0239334 A1 Sep. 19, 2013

Related U.S. Application Data

(63) Continuation of application No. 13/064,955, filed on Apr. 28, 2011, now Pat. No. 8,458,838.

(51) Int. Cl.

| | |
|---|---|
| ***B25F 1/00*** | (2006.01) |
| ***A62B 5/00*** | (2006.01) |
| ***A62C 8/00*** | (2006.01) |

(52) U.S. Cl.
USPC ..... 7/144; 7/158

(58) Field of Classification Search
USPC ..... 7/144–146, 158, 159, 161, 170; 30/123.6, 123.7, 187, 308.1, 308.2, 30/314, 315, 317, 366, 367; 29/278
See application file for complete search history.

(56) References Cited

U.S. PATENT DOCUMENTS 1,536,319 A * 5/1925 Yost ..... 7/158
2,490,684 A * 12/1949 Gosselin ..... 30/277

* cited by examiner

*Primary Examiner* — David B Thomas
(74) *Attorney, Agent, or Firm* — Breiner & Breiner, L.L.C.

(57) ABSTRACT

A multi-functional demolition tool is disclosed including a head assembly having a tip, a plurality of blades, and one or more movable talons; a handle shaft connected to the head assembly; an actuating mechanism for engaging and disengaging the talons; and a handle assembly, which may include a hammer end and/or pry bar end. The demolition tool is useful for, among other things, firefighters. The tool may be used to puncture a ceiling or other structure and to remove the ceiling material with the aid of the movable talons. The movable talons will automatically disengage if they hit an obstruction. The movable talons can be manually disengaged to prevent the tool from getting stuck in the ceiling or other structure.

14 Claims, 5 Drawing Sheets

11
11
20
22
24
26
28
30
32
34
36
37
38
39
40
42
44
46
48
50
52
54

10
10
79
70
74
73
72
39a
71
62
64
60
88
84
80
36
39
80
24
70
74
60
70
62
84
30
32
79
28
26
36
39
24
20
38
34
31
50
42
22
40
46
44

DEMOLITION TOOL

RELATED APPLICATION

This application is a continuation of U.S. Ser. No. 13/064,955 filed Apr. 28, 2011, which is incorporated herein by reference.

FIELD OF THE INVENTION

The present invention relates to a demolition tool. More particularly, the invention relates to a demolition tool having movable talons that move to and from disengaged and engaged positions.

BACKGROUND OF INVENTION

Demolition tools are known in the art. One primary use for such tools is in firefighting. The firefighter responding to a fire requires a tool useful in, among other things, getting to a fire in a building or other structure or to prevent the spread of the fire by removing flammable material in the path of the fire. The tool should be multi-functional having the ability to accomplish, including, but not limited to, (1) puncturing a hole in a ceiling, wall or similar structure; (2) the ability to pull the ceiling or wall material away from the supporting structure once the ceiling, wall or other structure has been punctured; (3) having a blunt end for knocking down or rupturing structures in the path of the firefighter; and (4) having a prying means to pry material from a ruptured structure out of the way.

For example, when a firefighter needs to get to a fire in the ceiling, or just needs to get into the ceiling to prevent the spread of a fire, he or she preferably needs to puncture the ceiling with a tool having a small cross-sectional area, to focus the energy of impact to improve its effectiveness and decrease physical stress on the user, and then expand the tool to remove large areas of the ceiling material to get to the fire or to prevent the spread of the fire. Most known demolition tools do not have this capability. Additionally, there may be joists, HVAC ducts or other structures in the ceiling that current demolition tools may catch on. Accordingly, present demolition tools may get hung up on such structures making it difficult, if not impossible, to remove the tool from the punctured ceiling. A tool is needed that is able, at the user's option, to decrease in size to allow it to be withdrawn without getting stuck on those structures.

Besides performing the above functions, a demolition tool must be easy to carry; not too heavy; durable to withstand the forces and impacts in firefighting or other demolition tasks; easy to grip and swing; made of a material sufficiently non-conductive to avoid electrical shock; easy to store, including on a fire truck; and generally easy to use.

The firefighting tools currently on the market are difficult to use in breaking through a ceiling, and once the ceiling is broken through, to pull down large areas of the ceiling material. As stated above, such tools may often get caught upon a structure in the ceiling such as a joist, duct or the like. The present demolition tools are not multi-functional requiring the use of different tools for different functions.

Accordingly, there is a need in the market for a multi-functional demolition tool for use by firefighters, police, SWAT teams, construction workers, fire restoration workers, or other similarly situated workers. The present invention meets this need and provides for an improved demolition tool.

SUMMARY OF THE INVENTION

A primary object of the present invention is to provide a multi-functional demolition tool.

Another primary object of the present invention is to provide a demolition tool that includes a head assembly having a small head for puncturing a structure, and movable talons that move from a disengaged position to an engaged position, enlarging the size of the head, for pulling down more of the structure material.

Another primary object of the present invention is to provide a demolition tool having a head assembly having movable talons that move from a disengaged position to an engaged position and, when in the engaged position, may be moved back to a disengaged position at the operator's choice to reduce the size of the head to avoid getting stuck or hung up on material behind the structure that has been punctured.

A further primary object of the present invention is to provide a demolition tool having a head assembly having a tip for puncturing a structure, blades adjacent the tip for entering the structure, and movable talons that may be engaged once the structure is punctured, wherein the talons are used to enlarge the size of the head to pull down more of the structure material; a means for engaging and disengaging the talons; a handle end for gripping the tool; and a handle end having a hammer end and/or pry bar end.

A further primary object of the present invention is to provide a demolition tool having a head assembly having movable talons that may be moved by the operator from a disengaged position to an engaged position utilizing a rotatable, slidable collar at a handle end of the demolition tool and a cooperating piston and gear mechanism at the head of the tool, and when in the engaged position, may individually move automatically downward to a disengaged position if pushed against an obstruction, as well as a means for the operator to choose to move the talons to the disengaged position to reduce the size of the head in order to clear an entanglement.

Other objects of the present demolition tool invention include, but are not limited to, providing a durable and easy to use tool that is simple in construction; providing a tool that can be used for multiple purposes; providing a tool that is able to be used to force entry into a building; providing a tool that can be used to remove structural framing, trim, windows, doors, window and door frames, and other structural elements; providing a tool that can be used as a striking tool; providing a tool that can be used as a prying tool; and providing a tool that can be used as an emergency escape aid for firefighters.

The demolition tool invention comprises a head assembly having a tip, a plurality of blades, and one or more movable talons; a handle shaft connected to the head assembly; means for engaging and disengaging the talons; and a handle end, which may include a hammer end and/or pry bar end.

The demolition tool further comprises a head assembly having a tip, a plurality of blades, and one or more movable talons; a handle shaft connected to the head assembly; means for engaging and disengaging the talons comprising a collar assembly which rotates and slides to actuate a piston and gear means to move the talons; and a handle end which may include a hammer end and/or pry bar end.

These and other objects of the invention will be apparent from the following description of the preferred embodiments of the invention and from the accompanying drawings.

BRIEF DESCRIPTION OF THE DRAWINGS

The following detailed description of specific non-limiting embodiments of the present invention can be best understood when read in conjunction with the following drawings, where like structures are indicated with like reference numbers.

DETAILED DESCRIPTION OF THE PREFERRED EMBODIMENTS

Figures 1, 2, 3:
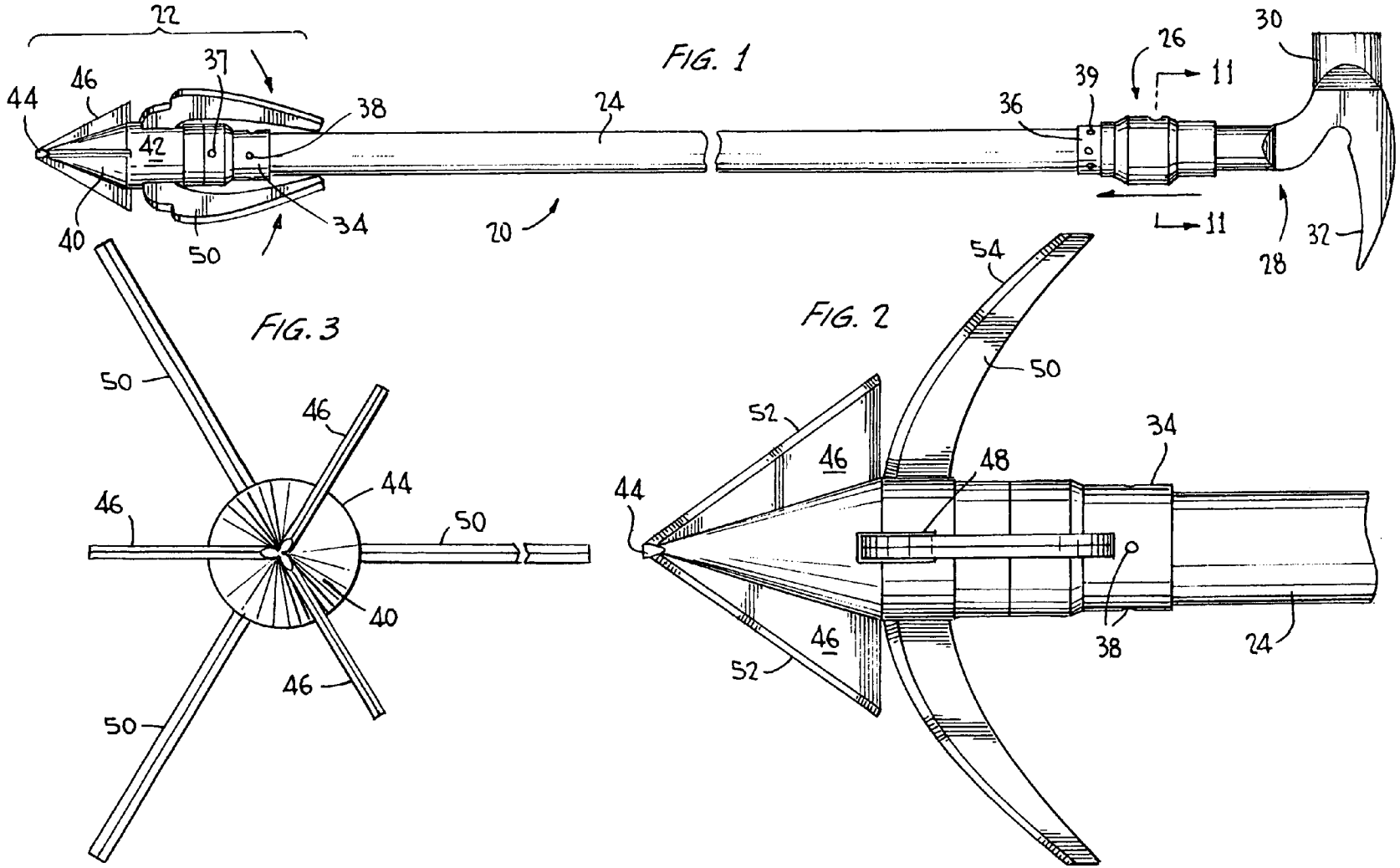
FIG. 1 is a perspective view of the demolition tool invention with talons in a disengaged position.
FIG. 2 is a perspective view of the head assembly of FIG. 1A.
FIG. 3 is a front view of the demolition tool of FIG. 1A showing a head assembly with a tip, blades and talons in an engaged position.
Figures 1A, 9, 10, 11:
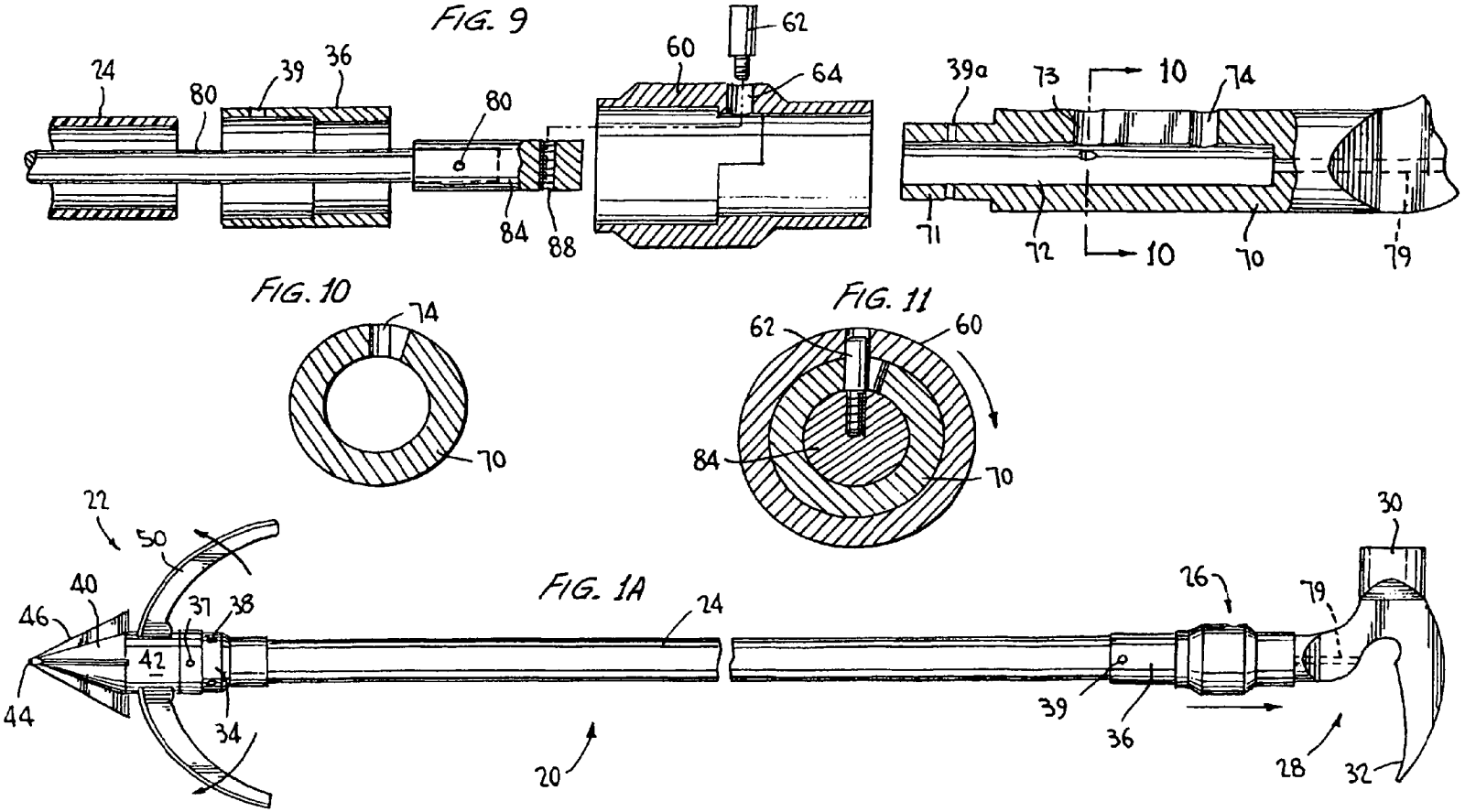
FIG. 1A is a perspective view of the demolition tool invention with talons in an engaged position.
FIG. 9 is an exploded view in partial cross-section of the handle assembly of the demolition tool invention showing a part of the means for engaging and disengaging talons.
FIG. 10 is a cross-section taken along line 10-10 of FIG. 9.
FIG. 11 is a cross-section taken along line 11-11 of FIG. 1.

The demolition tool 20 of the present invention is shown assembled in FIGS. 1 and 1A. FIG. 1 shows the demolition tool invention with the talons of the head assembly in a disengaged position and FIG. 1A shows the talons of the head assembly in an engaged position, all as discussed in greater detail hereafter. Generally, the demolition tool comprises a head assembly 22, a handle shaft 24, a handle assembly 26, a handle end 28, wherein the handle end may include a hammer end 30 and a pry bar end 32. The head assembly 22 is attached to the handle shaft 24 by a collar 34 and the handle assembly 26 is attached to the handle shaft 24 by collar 36. Head assembly 22 is connected to collar 34 by any suitable fastening means such as screws 38 and handle assembly 26 is connected to collar 36 by any suitable fastening means such as screws 39.

The demolition tool invention will be further described by the major components thereof, namely the head assembly 22, the handle shaft 24, the handle assembly 26 and the handle end 28. Thereafter, the actuating mechanism for engaging and disengaging the talons will be discussed in greater detail, including the parts thereof.

The head assembly 22 generally includes a cone-shaped member 40 having a shaft 42. Cone-shaped member 40 includes a tip 44, preferably chisel-shaped as best shown in FIG. 2, and a plurality of blades 46. Shaft 42 includes apertures 48 for receiving a plurality of talons 50. The portion of the head assembly including the cone member 40 and shaft 42 with blades 46 may be made of aluminum and preferably as one piece, although any other durable metal material or hard resin material may be used. It should also be understood that the blades may be made as a separate and replaceable component of the head assembly. In a preferred embodiment, the head assembly includes three blades 46, although a different number of blades may be used without departing from the scope of the invention. The blades in a preferred embodiment are tapered and include a sharp edge 52 for cutting through structural material such as a drywall ceiling. The blades also, while not shown, may have serrated edges. Talons 50 are inserted through apertures 48 in the head assembly as discussed below and may have a tapered or sharp edge 54. The talons 50 are movable from a disengaged position to an engaged position by an actuating means as discussed hereafter. The talons 50, when in the engaged position, are constructed so that they will collapse and disengage if they hit a structure, e.g. a HVAC duct, when the tool is in use. Three talons 50 are disclosed in the presently preferred embodiment, although a different number of talons may be used.

The handle shaft 24 is made of a non-conductive material such as fiberglass or other durable non-conductive material. This may preclude injury in the event the demolition tool comes into contact with a live electrical line.

The handle assembly 26 includes a rotatable and slidable collar 60 that is attached at the handle end 28. Collar 60 may have a non-smooth surface, such as a knurled surface, for ease of gripping. Handle end 28 includes hammer end 30 and pry bar end 32. The handle end 28 is preferably a unitary part, although it may be made of separate components. Extending from handle end 28, and preferably part thereof, is an actuating end 70 that forms part of the handle assembly 26 for use in actuating the talons 50. End 70 includes a sleeve end 71 that fits inside collar 36 and is connected by fastening means such as screws 39 in screw apertures 39*a*.

Referring to FIGS. 5, 9, 10, and 11, the actuating mechanism for actuating talons 50 will now be described in greater detail and generally comprises a rotatable and slidable collar 60 that slides over top of actuating end 70 of handle end 28 that includes a track 72 and notches 73 and 74. Additionally, end 70 includes a longitudinal drain 79 to allow for drainage of any water entering the tool. The collar 60 includes a pin 62 that slides in track 72 and will engage notches 73 or 74 when the collar 60 is slid in track 72 and then rotated. Collar 60 is connected to a rod 80 by pin 62 as discussed below. Rod 80 is located inside handle shaft 24 and is preferably made of fiberglass or other non-conductive material. Rod 80 includes end pieces 82 and 84 at each end of the rod. The end pieces 82 and 84 are preferably made of aluminum and attached to rod 80 by any suitable fastening means such as screws 86, although other fastening means such as an adhesive may be used. Rod 80 is attached to handle assembly 26 and head assembly 22 for moving talons 50 as discussed below, and moves in a longitudinal direction in cooperation with the actuating means to engage and disengage talons 50.

Figure 5:
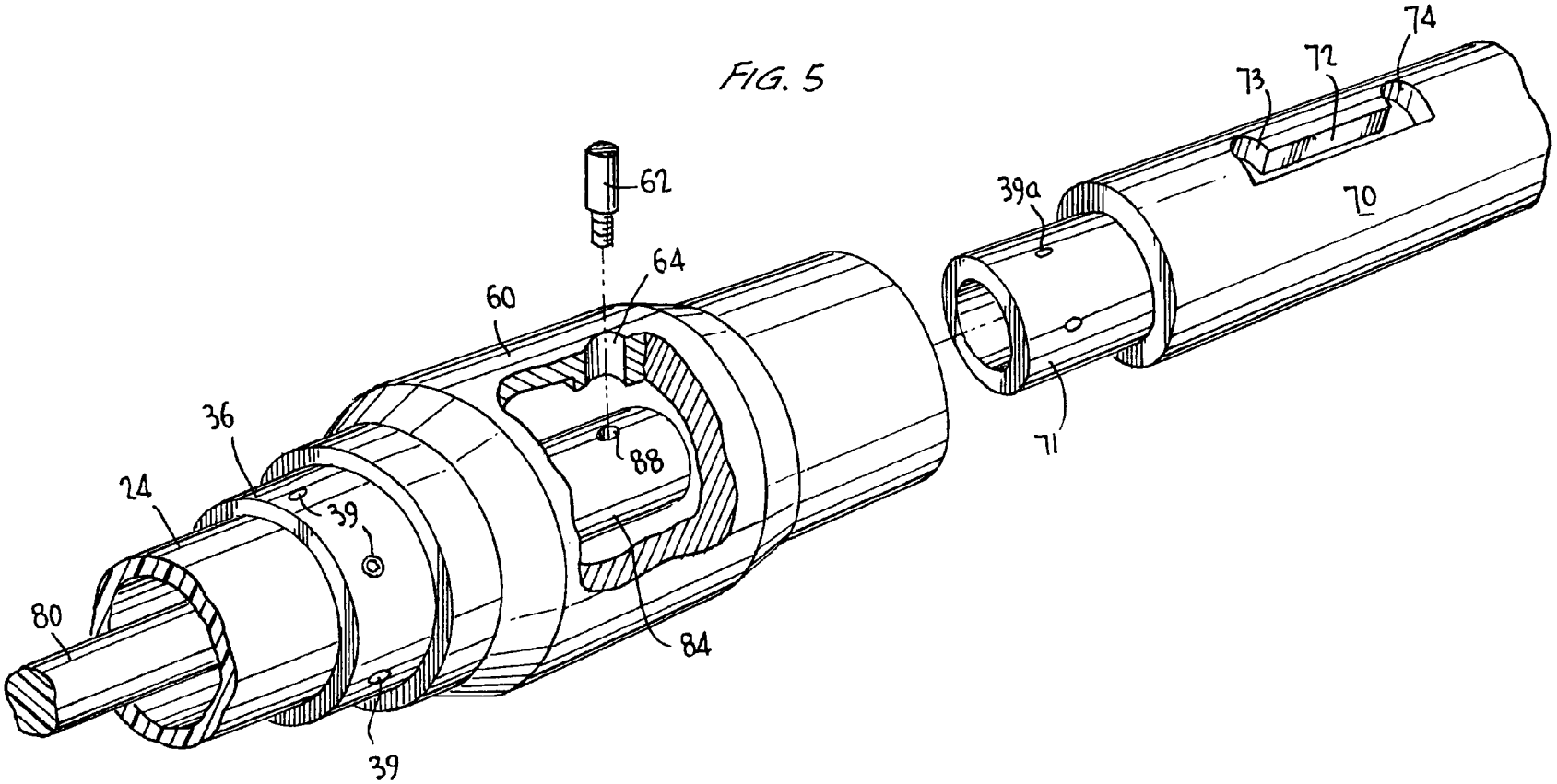
FIG. 5 is a perspective view in partial cross-section of the handle assembly of the demolition tool invention.

Referring to FIGS. 5, 9 and 11 in reference to the handle assembly 26, pin 62 fits through annular recess 64 in collar 60, through track 72 of actuating end member 70, and engages threads 88 in end piece 84 to allow rod 80 to slide in track 72 of actuating end member 70 toward handle end 28 as shown in FIG. 1A when engaging or opening talons 50. As shown in FIG. 11, when engaging talons 50, collar 60 may be rotated so that pin 62 moves out of first forward notch 73, slides in track 72 toward handle end 28, and is rotated back to engage notch 74 to hold collar 60 in place.

Figures 4, 6:
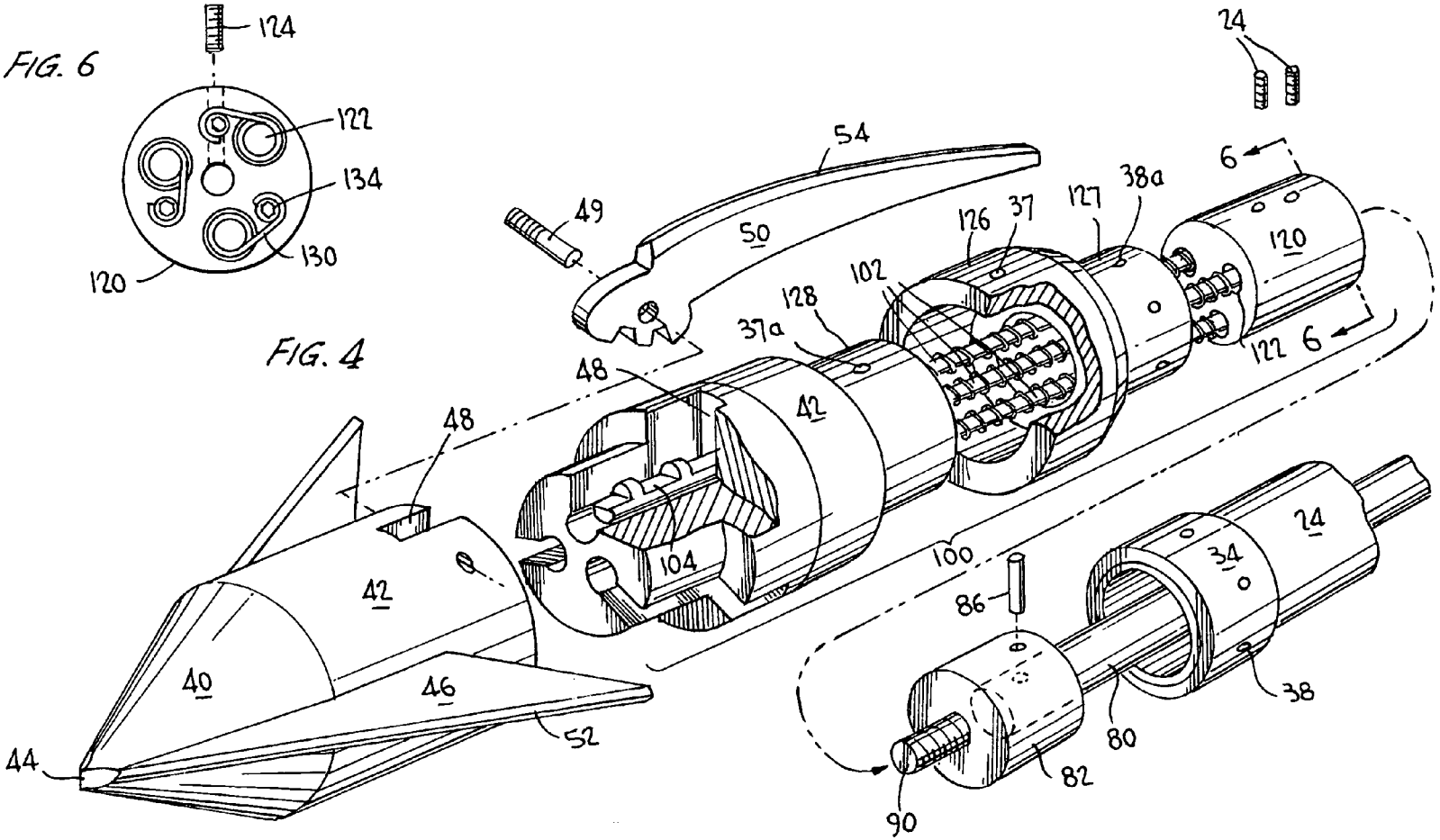
FIG. 4 is an exploded view in partial cross-section of the head assembly of the demolition tool invention.
FIG. 6 is a perspective view taken along line 6-6 of FIG. 4.

Referring now to FIG. 4 and the head assembly 22, rod 80 includes end piece 82 having a threaded member 90 extending therefrom for engaging a piston means 100 that cooperates with talons 50 for moving talons 50 from a disengaged position to an engaged position (and back) in conjunction with the handle assembly 26.

Figure 7:
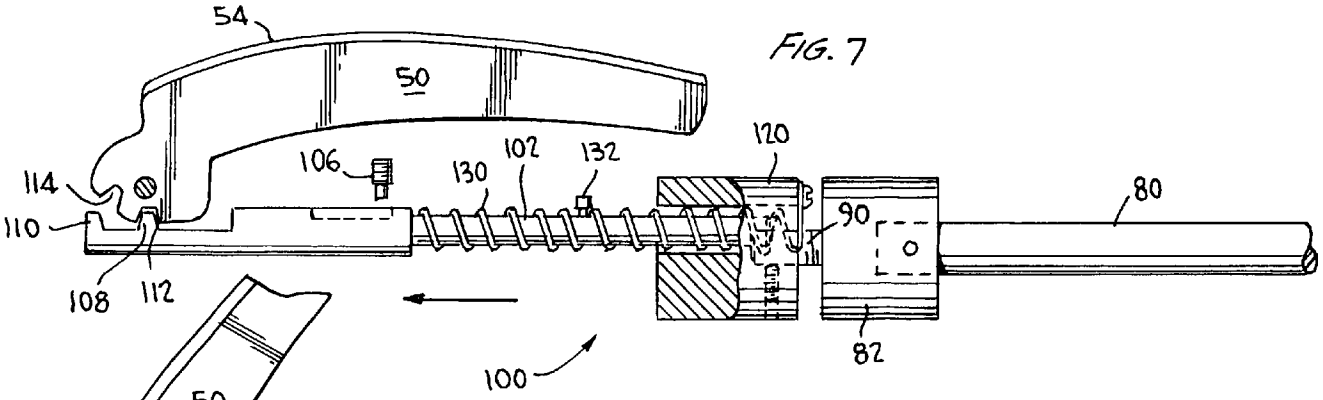
FIG. 7 is a perspective view in partial cross-section of a talon and part of the talon actuating means with the talon in a disengaged position.
Figure 8:
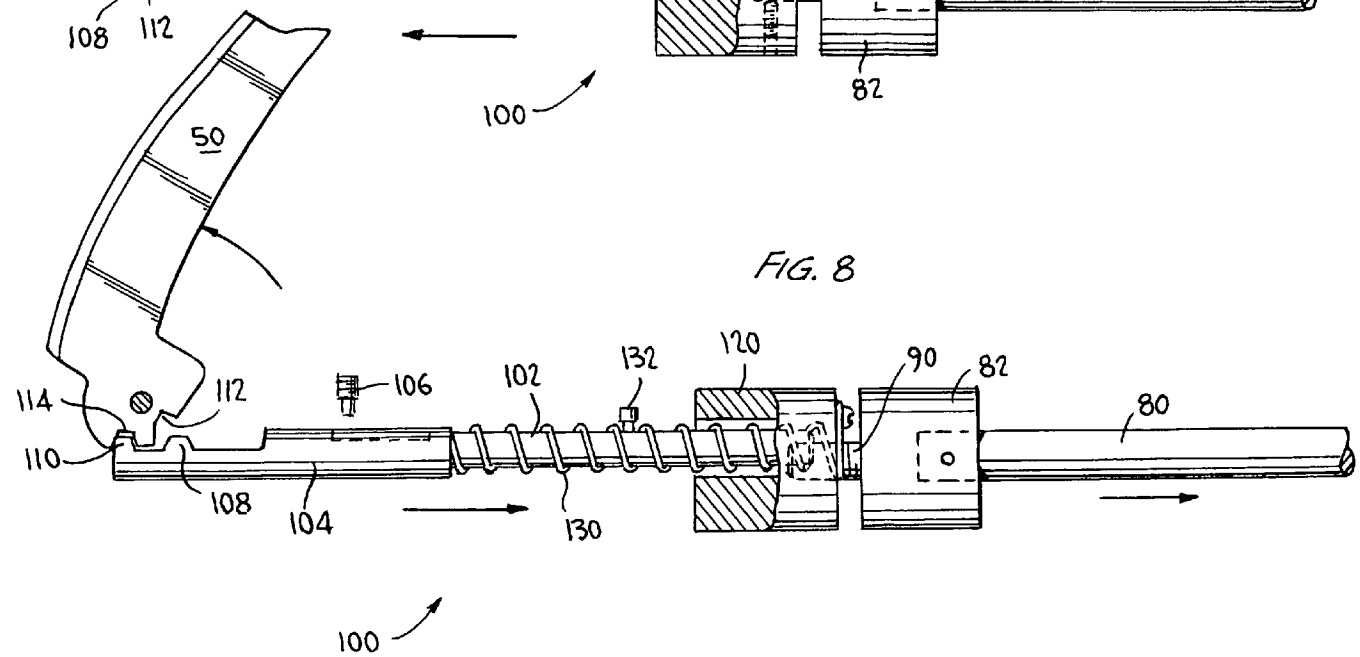
FIG. 8 is a perspective view in partial cross-section of a talon and part of the talon actuating means with the talon in an engaged position.

Referring now to FIGS. 4, 6, 7 and 8, the piston means 100 will be described in further detail. In a preferred embodiment, the piston means 100 includes three pistons 102 for individually moving each of the three talons 50. It should be understood that a single piston may be used to engage and disengage all three of the talons 50. At the end of the pistons 102 is gear member 104 held in place by any suitable fastening means such as screw 106. Gear member 104 includes gear teeth 108 and 110. Gear teeth 108 and 110 mate with corresponding gear grooves 112 and 114 of talon 50 as best shown in FIGS. 7 and 8. FIG. 7 shows the talons 50 in the disengaged or closed position and FIG. 8 shows the talons 50 in the engaged or open position.

A preferred structure of the piston means 100 will now be described in further detail. Again referring to FIGS. 4, 6, 7 and 8, threaded member 90 of end piece 82 engages tubular member 120 by corresponding female threads. Tubular member 120 includes annular grooves 122 that receive the ends of pistons 102. These pistons are held in tubular member 120 by any suitable fastening members such as alien screws 124 as best shown in FIG. 6. Pistons 102 extend through collar member 126 that mates with sleeve 128 of shaft 42. Collar 126 is connected to shaft 42 by a fastening means 37 such as a screw which mates with aperture 37*a*. Collar member 126 includes a sleeve end 127 that fits in collar 34 and attaches to collar 34 by screws 38 at apertures 38*a* to attach the head assembly 22 to handle 24. Additionally, each piston member 102 includes a spring 130 surrounding a portion of the piston member and held in place on piston 102 by a fastening member such as screw 132 and secured to tubular member 120 by screws 134 as seen in FIG. 6. Springs 130 are typically in a non-tensioned, non-compressed state, and thereby aid in maintaining talons 50 in a disengaged position as shown in FIG. 7. When the talons are engaged, springs 130 will allow the talons to be pushed into a disengaged position, such as when pushing against an obstruction, and then springs 130 will automatically return the talon to an engaged position once the obstruction is cleared. The talons 50 fit into the head assembly 22 through apertures 48 and are held in place by a fastening member such as knurl pin 49.

The operation of the actuating means for engaging and disengaging talons 50 will now be discussed in relation to the parts described above. Referring to FIG. 1, the demolition tool shows the talons 50 in a disengaged position. To engage the talons as shown in FIGS. 1A, 2 and 3, collar 60 is grasped, rotated and slid longitudinally toward handle end 28. Pin 62 travels in track 72. When reaching the end of the track, collar 60 is rotated to engage the pin in notch 74. In such movement, rod 80 is moved toward handle end 28. This moves pistons 102 and gears 104 toward the handle end. Gear teeth 108 disengage from gear grooves 112 and gear teeth 110 engage gear grooves 114, thereby causing talons 50 to move into an engaged or open position as shown, for example, in FIGS. 7 and 8. Springs 130 of piston means 100 place tension on pistons 102, causing talons 50 to remain in an engaged or open position. The talons 50 are held in the engaged position. However, if any talon 50 makes contact with a structure when the tool is in use in such a way that the talon 50 is being pushed inward toward a disengaged position, that corresponding piston 102 is free to move individually and independently from the other pistons 102, stretching spring 130, allowing the talon to collapse into a disengaged position. As soon as the obstruction is cleared, since spring 130 is under tension, spring 130 will pull piston 102 back into the engaged position, causing talon 50 to return to the engaged position.

The use of the demolition tool 20 will now be discussed in further detail in reference to a firefighter fighting a fire, although it is understood that the tool may be used in other circumstances, including by the police, construction workers or the like. A firefighter carrying the tool and entering a building on fire may come upon a fire in the ceiling of the building. The firefighter grips the handle shaft 24 and handle end 28 and propels the demolition tool upward into the ceiling. Tip 44 punctures the ceiling and blades 46 further puncture the ceiling making a hole in the ceiling for the head of the tool to enter the ceiling. Once the head of the tool enters the ceiling, collar 60 is rotated and slid longitudinally toward handle end 28 that moves talons 50 into the engaged position as shown in FIGS. 1A, 2 and 3. Thereafter, the firefighter may pull down on the tool removing the material. Alternatively, the firefighter may choose to rotate collar 60 first, engaging or opening the talons 50 before puncturing the ceiling, and the talons 50 are able to individually and independently fold inward to a disengaged position as necessary and will then automatically deploy outward to an engaged position as soon as the ceiling is penetrated, allowing the firefighter to then pull down on the tool removing the material. In either operation, if one or more of the talons 50 engages a fixed structure in the ceiling causing that tool to become stuck, the firefighter may choose to rotate collar 60 and slide it toward the head of the tool to disengage all of the talons 50, reducing the size of the head, thereby clearing the obstruction, and allowing the firefighter to pull the demolition tool from the ceiling. The tool has further uses as a firefighter may grip the tool handle near the head assembly and use the hammer end 30 to break through the desired structure. Once the hammer end has broken through the structure, the pry bar 32 may be used to pry material away from the structure.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A demolition tool comprising:

a head assembly having a tip, a plurality of blades, and one or more movable talons, a handle shaft connected to said head assembly, and a handle end, wherein said handle end includes a hammer end and/or pry bar.

2. A demolition tool according to claim 1 wherein said demolition tool includes a means for engaging and disengaging said one or more talons comprising a rotatable and slidable collar, a rod extending through said handle shaft and piston means that is connected to said one or more movable talons, all constructed and arranged to engage and disengage said talons.

3. A demolition tool according to claim 2 wherein said piston means comprises a piston rod having a gear member constructed and arranged for engaging a corresponding gear member on said one or more talons.

4. A demolition tool according to claim 2 wherein said handle end includes an actuating means constructed and arranged to cooperate with said rotatable and slidable collar.

5. A demolition tool according to claim 1 comprising means for said one or more movable talons to move from an engaged position to a disengaged position when said one or more movable talons engages an obstruction when in use.

6. A demolition tool according to claim 1 wherein said plurality of blades comprises three blades and wherein said one or more talons comprises three talons.

7. A demolition tool comprising:

a head assembly having a puncturing member and one or more movable talons, a handle shaft connected to said head assembly, a handle end, said handle end having a hammer end and/or pry bar end, and a means for engaging and disengaging said one or more talons.

8. A demolition tool according to claim 7 wherein said means for engaging and disengaging said one or more talons comprises at said handle end a rotatable and slidable collar, a rod extending through said handle shaft and a piston means that is connected to said one or more movable talons, all constructed and arranged to engage and disengage said talons.

9. A demolition tool according to claim 8 wherein said piston means comprises a piston rod having a gear member constructed and arranged for engaging a corresponding gear member on said one or more talons.

10. A demolition tool according to claim 8 wherein said handle end includes an actuating means constructed and arranged to cooperate with said rotatable and slidable collar.

11. A demolition tool according to claim 10 wherein said actuating means comprises a sleeve having a track means and notch members.

12. A demolition tool according to claim 7 further comprising means for said one or more movable talons to move from an engaged position to a disengaged position when said one or more movable talons engages an obstruction when in use.

13. A demolition tool according to claim 7 wherein said puncturing member comprises a tip member and a plurality of blades.

14. A demolition tool comprising:

a head member having a puncturing member, a handle shaft connected to said head member, and a handle end comprising a hammer end, a pry bar end, and a member connecting said hammer end and said pry bar end wherein said member has a top surface, a bottom surface and side wall surfaces, said top surface, said bottom surface and said side wall surfaces being substantially smooth to allow gripping of said member of said handle end.

* * * * *